United States Patent [19]

Nakatani et al.

[11] Patent Number: 5,012,651

[45] Date of Patent: May 7, 1991

[54] HEAT PUMP APPARATUS

[75] Inventors: Kazuo Nakatani, Kadoma; Mitsuhiro Ikoma, Ikoma; Yuji Yoshida, Itami; Takeshi Tomizawa, Ikoma; Koji Arita, Osaka; Minoru Tagashira, Hirakata, all of Japan

[73] Assignee: Matsushita Electric Industrial Co., Ltd., Osaka, Japan

[21] Appl. No.: 457,234

[22] Filed: Dec. 26, 1989

[30] Foreign Application Priority Data

Dec. 28, 1988 [JP] Japan ..... 63-334451
Mar. 10, 1989 [JP] Japan ..... 1-058325
Apr. 6, 1989 [JP] Japan ..... 1-087620

[51] Int. Cl.[5] ..... F25B 45/00

[52] U.S. Cl. ..... 62/149; 62/174; 62/502

[58] Field of Search ..... 62/114, 502, 149, 174, 62/324.1

[56] References Cited

U.S. PATENT DOCUMENTS 4,384,460 5/1983 Vakil ..... 62/114
4,580,415 4/1986 Sakuma et al. ..... 62/502
4,624,114 11/1986 Sakuma et al. ..... 62/502
4,722,195 2/1988 Suzuki et al. ..... 62/502 X
4,840,042 6/1989 Ikomo et al. ..... 62/114 X

*Primary Examiner*—William E. Tapolcai
*Attorney, Agent, or Firm*—Stevens, Davis, Miller & Mosher

[57] ABSTRACT

The structure is arranged in such a manner that nonazeotropic mixed refrigerant is enclosed therein and a fractioning/separating device is disposed in a low pressure circuit in the main circuit of refrigerating cycle so as to conduct separation operation, the fraction/separation can be conducted at a low pressure in a separation mode, the specific volume of refrigerant gas generated in a reservoir due to heat supplied from a heater is enlarged, and the velocity of gas which moves upwards in the fractioning/separating device can be increased, causing a gas-liquid contact to be promoted. As a result, high performance separation can be conducted at reduced quantity of heat, causing the density of high boiling point refrigerant reserved to be significantly raised. Thus, the composition in the main circuit becomes a composition enriched with low boiling point refrigerant exhibiting excellent heating performance so as to satisfactorily cope with an increase in the load.

14 Claims, 5 Drawing Sheets

HEAT PUMP APPARATUS

BACKGROUND OF THE INVENTION

1. Field of the Invention

The present invention relates to an improvement in a heat pump apparatus of a type using nonazeotropic mixed refrigerant and capable of varying its composition by reserving high boiling point refrigerant through the separation of composition.

We have disclosed in apparatus as shown in FIG. 9 arranged to use nonazeotropic mixed refrigerant and capable of varying its composition by retaining high boiling point refrigerant through the separation of composition. Referring to FIG. 9, reference numeral 1 represents a compressor, 2 represents a condenser, 3 represents a main restrictor, and 4 represents an evaporator. The main circuit of the heater apparatus is formed by connecting the above-described elements. Reference numeral 5 represents a fractioning/separating device filled with filler, the fractioning/separating device 5 having the upper portion connected to an outlet port of the condenser 2 via a pipe 6 and also connected to an inlet port of the evaporator 4 via an auxiliary restrictor 7. A reservoir 8 is disposed below the fractioning-/separating device 5, the bottom of the reservoir 8 being connected to the auxiliary restrictor 7 via a valve 9. Furthermore, a heater 10 is disposed in reservoir 8.

Then, the method of varying the composition of enclosed nonazeotropic mixed refrigerant will be described. In the case where the apparatus is operated with the composition of the enclosed mixed-refrigerant being retained as it is (in non-separation mode), the operation of the heater 10 is stopped. In this case, the reservoir 8 acts to only retain excess refrigerant in such a manner that it retains the excess refrigerant when the valve 9 is closed while it retains the same, and as well discharges a portion of refrigerant to the evaporator 4 via the auxiliary restrictor 7 when the valve 9 is opened, causing no change in the composition to take place. Therefore, the main circuit is caused to be operated while maintaining the composition of the enclosed mixed-refrigerant enriched with high boiling point refrigerant.

On the other hand, in the case where the apparatus is operated with refrigerant of the composition enriched with low boiling point refrigerant while retaining high boiling point refrigerant (in a separation mode), the low boiling point refrigerant in the refrigerant in the reservoir 8 is mainly evaporated, the evaporated low boiling point refrigerant then moving upwards through the fractioning/separating device 5 when the valve 9 is closed and the heater 10 is operated. At this time, liquid refrigerant is supplied from the outlet port of the condenser 2 via the pipe 6 so that fraction takes place in the fractioning/separating device 5 due to a gas-liquid contact. As a result, the density of the low boiling point refrigerant in the gas which is moving upwards is raised, while the density of the high boiling point refrigerant in the liquid moving downwards, is raised. As a result, high boiling point refrigerant in the form of a condensed liquid is retained in the reservoir 8. On the other hand, the gas which is moving upwards and enriched with low boiling point refrigerant is introduced into the evaporator 4 via the auxiliary restrictor 7. Therefore, the main circuit can be operated while maintaining the composition enriched with the low boiling point refrigerant.

In the case that the heat pump apparatus of the above-described type which is capable of varying the composition is used, for example, in a hot water supply apparatus in which when hot water is intended to be obtained, the apparatus is operated while maintaining the enclosed composition enriched with high boiling point refrigerant whose condensing pressure is low so as to improve the reliability of the compressor or the like. When hot water is reserved in a short time by utilizing high heating performance, the apparatus can be operated while maintaining the composition enriched with low boiling point refrigerant which exhibits excellent heating performance.

However, since the heat pump apparatus of the type described above is operated with the pressure of its fractioning/separating device which is as high as the pressure in the main circuit, the separating performance of the fractioning/separating device has been insufficient. That is, it has been known that the performance of the fractioning/separating device can be improved by raising the velocity of the gas which moves upwards in the fractioning/separating device. If separation is conducted at high pressure as described above, the specific volume of the gas generated in the reservoir due to heat applied from the heater is reduced, causing the velocity of the gas in the fractioning/separating device to be reduced. Therefore, the apparatus of the type described above suffers from insufficient separating performance. In order to overcome the insufficient separating performance, the quantity of heat of the heater has been increased in the conventional apparatus. It leads to the reduction in the coefficient of performance. Furthermore, if separation is conducted at high pressure, the saturated temperature of the refrigerant in the reservoir is raised excessively, causing problems in terms of the heat resistance of the devices and unnecessary heat radiation to occur.

SUMMARY OF THE INVENTION

An object of the present invention is to provide a refrigerating cycle structure capable of conducting high performance separation with a reduced quantity of applied heat and capable of being used even if the load or the temperature changes excessively.

In order to achieve the above-described object, a heat pump apparatus according to the present invention is arranged in such a manner that nonazeotropic mixed refrigerant is enclosed therein and a fractioning-/separating device is disposed in a low pressure circuit in the main circuit of a refrigerating cycle so as to conduct a separation operation. Therefore, since the fraction/separation can be conducted at a low pressure in a separation mode, the specific volume of refrigerant gas generated in a reservoir due to heat supplied from a heater is enlarged, and the velocity of gas which moves upwards in the fractioning/separating device can be increased, causing a gas-liquid contact to be promoted. As a result, high performance separation can be conducted at reduced quantity of heat, causing the density of high boiling point refrigerant reserved to be significantly raised. Thus, the composition in the main circuit becomes a composition enriched with low boiling point refrigerant exhibiting excellent heating performance so as to satisfactorily cope with an increase in the load.

DESCRIPTION OF THE PREFERRED EMBODIMENTS

Figure 1:
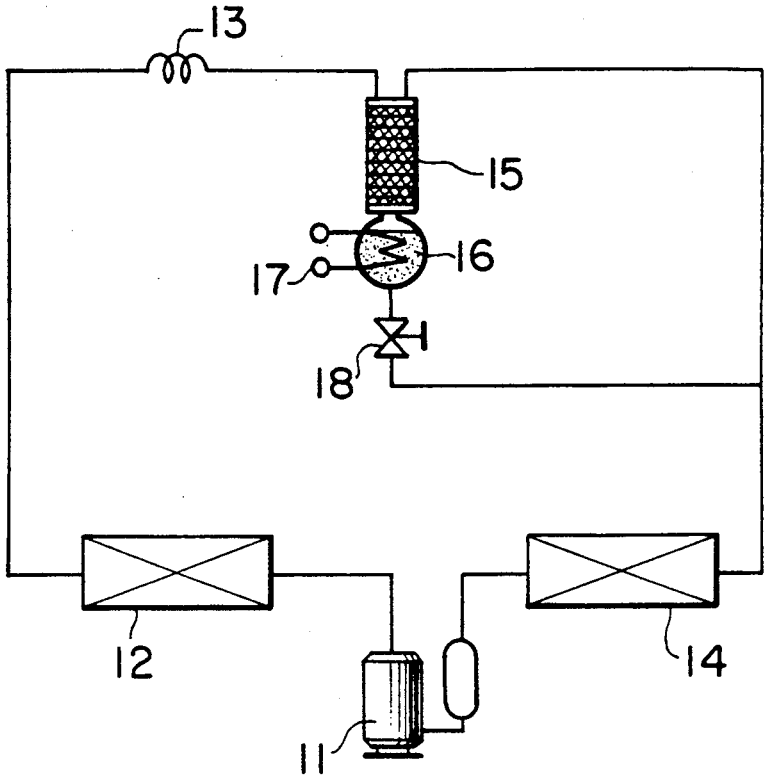
FIG. 1 is a view which illustrates the structure of a heat pump apparatus according to the present invention and arranged such that a refrigeranting/separating device is provided in the low pressure side of the main circuit.

FIG. 1 is a view which illustrates an embodiment of a heat pump apparatus according to the present invention. Referring to the drawing, reference numeral 11 represents a compressor, 12 represents a utilization side heat exchanger (a condenser), 13 represents a restrictor, which are sequentially connected via pipes. Reference numeral 14 represents a heat source side heat exchanger (an evaporator), and 15 represents a fractioning-/separating device filled with filler. The upper portion of the fractioning/separating device 15 is connected to the outlet port of the restrictor 13, the upper portion also being connected to the inlet port of the heat source side heat exchanger 14. Furthermore, the outlet port of the heat source side heat exchanger 14 and the compressor 11 are connected to each other. Thus, the main circuit of the heat pump is constituted. A reservoir 16 and a heater 17 are disposed below the fractioning-/separating device 15, the reservoir 16 having the lower portion connected to the inlet port of the heat source side heat exchanger 14 via a valve 18. The structure is arranged such that refrigerant in the reservoir 16 is heated by the heater 17.

The manipulation and the operation of the heat pump apparatus for varying the composition of enclosed nonazeotropic mixed refrigerant will be described.

In a non-separation mode, refrigerant discharged from the restrictor 13 is introduced into the reservoir 16 via the refraction/separating device 15 by opening the valve 18, the reservoir 16 retaining excess refrigerant. Refrigerant which has not been retained reaches the heat source side heat exchanger 14 via the valve 18. As a result, the main circuit is caused to be operated while maintaining the composition of the mixed refrigerant enriched with high boiling point refrigerant whose state has been unchanged from the time when it was enclosed.

In a separation mode, the valve 18 is closed and the heater 17 is operated. As a result, low boiling point refrigerant of liquid refrigerant in the reservoir 16 is mainly evaporated, the evaporated refrigerant then moving upwards in the fractioning/separating device 15. At this time, two-phase refrigerant consisting of liquid and gas is supplied from the outlet port of the restrictor 13 to the upper portion of the fractioning-/separating device 15. A portion of the thus supplied liquid refrigerant moves downward in the fractioning-/separating device 15. Then, the liquid refrigerant encounters a gas-liquid contact with gas which is moving upwards, causing fraction to take place. As a result, the density of the low boiling point refrigerant in the gas which is moving upwards is raised, while the density of the high boiling point refrigerant in the liquid refrigerant in the liquid which is moving downwards is raised. Thus, the reservoir 16 retains high boiling point refrigerant in the form of condensed liquid. On the other hand, the gas enriched with low boiling point refrigerant which has moved upwards is mixed with the residual portion of the supplied refrigerant before being introduced into the heat source side heat exchanger 14. As a result, the main circuit can be operated while maintaining the composition of the mixed refrigerant enriched with low boiling point refrigerant.

In this case, since the pressure in the fractioning-/separating device 15 is arranged to be as low as the pressure in the main circuit, the specific volume of the gas generated in the reservoir 16 due to the heat from the heater 17 is large enough, and the velocity of the gas which is upward moving in the fractioning/separating device 15 is thereby increased. As a result, the gas-liquid contact is promoted, causing the separating performance of the fractioning separating device 15 is improved. Therefore, the density of the high boiling point refrigerant reserved in the reservoir 16 can be significantly raised. Since the composition of the refrigerant in the main circuit becomes a composition enriched with low boiling point refrigerant which has a significant heating performance, the main circuit can satisfactorily cope with an increase in load.

In this case, since the pressure in the reservoir 16 is as low as the pressure of the refrigerant in the main circuit, the saturation temperature for the refrigerant in the reservoir 16 can be lowered, and the heat radiation from the heater 17 can be reduced.

When the composition of the refrigerant in the main circuit is intended to restore, it is necessary to only open the valve 18 since the high boiling point refrigerant in the reservoir 16 is mixed with that in the main circuit, causing the composition of the refrigerant in the main circuit to become a composition enriched with high boiling point refrigerant whose state has been unchanged from the time when it was enclosed.

As described above, the composition of refrigerant in the main circuit can be significantly varied by simply operating the valve 18 and the heater 17. Therefore, the composition of the refrigerant can be easily controlled so as to cope with the magnitude of the load applied. As a result, the range in which the performance can be varied can be widened.

Although the restrictor 13 and the heat source side heat exchanger 14 are connected to each other via the upper portion of the fractioning/separating device 15 according to this embodiment, the restrictor 13 may be directly connected to the heat source side heat exchanger 14 via another pipe. In this case, only liquid refrigerant which moves downwards in the fractioning-/separating device 15 is introduced into the upper portion of the fractioning/separating device 15, causing fraction to occur. The residual portion of the refrigerant is directly introduced into the heat source side heat exchanger 14. As a result, the fraction can be surely conducted without disordering the gas-liquid contact taken place in the fractioning/separating device 15.

When nonazeotropic mixed refrigerant used in this embodiment is arranged to be composed by R22, which has been mixed in a range of composition with which the vapor pressure becomes substantially the same as that of R12, and refrigerant having a boiling point higher than that of R22, the refrigerant having the boiling point higher than that of R22 can be fractioned and separated in the heat pump apparatus. Therefore, the vapor pressure can be lowered by using the mixed refrigerant as it is in the case where the condensing temperature is at a high level, while the refrigerant having a higher boiling point than that of R22 is separated in the case where the operation temperature is low, thereby high heating performance can be realized.

It will be described in detail. Refrigerant to be mixed with R22, having the boiling point higher than that of R22 and its boiling point are exemplified: R134a (−26.5° C.), R152a (−25.0° C.), R134 (−19.7° C.), R124 (−12.0° C.), R142b (−9.8° C.), RC318 (−5.8° C.), R143 (5.0° C., R123 (27.1° C.), R123a (28.2° C.), and R141b (32.0° C.), which possess limited possibility of destructing ozone layers and form nonazeotropic mixed refrigerant together with R22.

Figure 2:
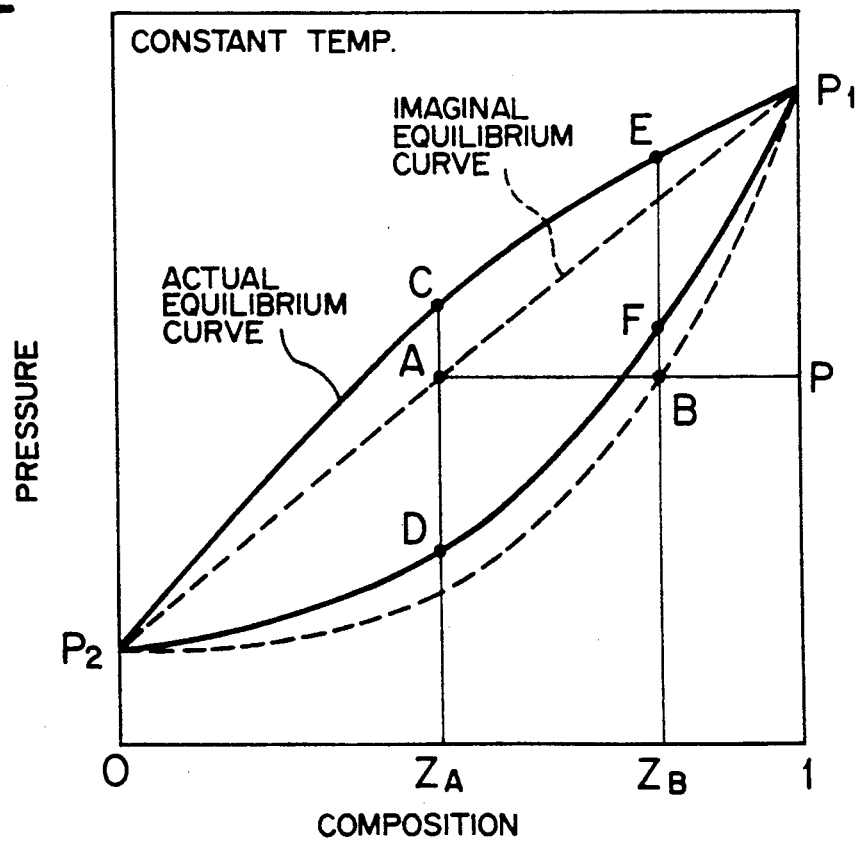
FIG. 2 is a view which illustrates a method of specifying the range of the compositions of the mixed refrigerant, the refrigerant composition serving as a component of the present invention.

It is preferable that the vapor pressure be substantially equal to that of R12 for the purpose of preparing the case where the condensing temperature is at a high level. In general, although it is difficult to specify a vapor pressure for the mixed refrigerant, the range of the composition of the mixed refrigerant can be simply specified in accordance with a method described with reference to FIG. 2.

(1) Vapor pressure $P_1$ and $P_2$ of the corresponding component 1 (R22) and component 2 (refrigerant having a boiling point higher than that of R22) at the aimed highest condensing temperature are obtained.

(2) Liquid phase composition $Z_A$ of point A of imaginary ideal solution at vapor pressure $P_3$ of R12 is obtained.

$$Z_A = \frac{P_3 - P_2}{P_1 - P_2}$$

(3) Gas phase composition $Z_B$ at point B of imaginary ideal vapor at vapor pressure $P_3$ of R12 is obtained.

$$Z_B = \frac{P_1(P_3 - P_2)}{P_3(P_1 - P_2)}$$

The thus obtained composition range $Z_A$ to $Z_B$ is composition $Z_1$ of component 1 (R22) whose vapor pressure is substantially equal to that of R12. The specifying of $(1-Z_1)$ as the composition of component 2 (refrigerant having a boiling point higher than that of R22) causes the range of the composition of mixture of R134a, R152a, R134, R124, R142b, RC318, R143, R123, R123a, and R141b to be easily specified. Although R152a, R142b, R143, and R141b are classified as combustible refrigerant, a range in which the above-described refrigerant is combustible can be avoided surely by conducting the mixture in accordance with the above-described composition range. In order to further surely avoid the combustible range, incombustible refrigerant such as R134a, R134, R124, RC318, R123, and 123a may be mixed as the third refrigerant.

Although the apparatus is operated with the heater activated in the separation mode according to this embodiment, the heater 17 may be activated for a certain time period and thereafter only the activation of the heater 17 may be stopped while operating the apparatus. In this case, since the high boiling point refrigerant in the reservoir 16 is cooled while maintaining its density and is reserved in the reservoir 16 as supercooled liquid, the composition enriched with the low boiling point refrigerant can be retained in the main circuit. Therefore, the quantity of heat required for the heater 17 to conduct the separating action can be reduced.

Figure 3:
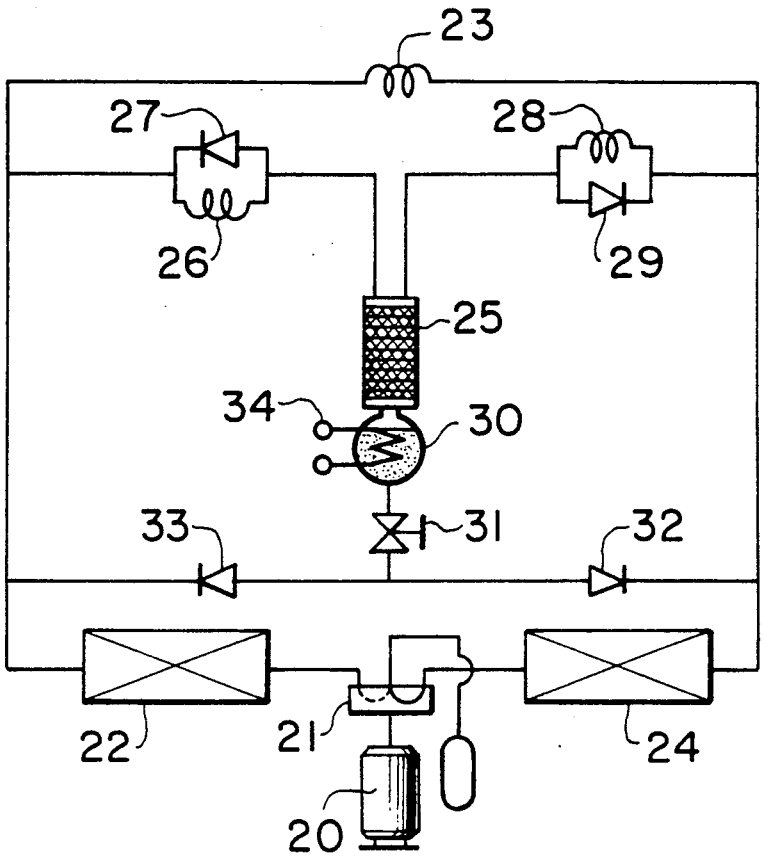
FIG. 3 is a view which illustrates an embodiment of the heat pump apparatus according to the present invention and structure so as to be capable of switching the mode between heating and cooling operations.

FIG. 3 is a view which illustrates an embodiment of the heat pump apparatus according to the present invention and structured so as to conduct the switching between the heating and cooling operations. Referring to the drawing, reference numeral 20 represents a compressor, 21 represents a four-way valve, 22 represents a utilization side heat exchanger, 23 represents a main restrictor and 24 represents a heat source side heat exchanger. The main circuit of the heat pump apparatus according to this embodiment is formed by connecting the above-described elements via pipes. Reference numeral 25 represents a fractioning/separating device filled with filler, the fractioning/separating device 25 having the upper portion connected to a pipe arranged between the utilization side heat exchanger 22 and the main restrictor 23 via a parallel circuit consisting of a first auxiliary restrictor 26 and a first check valve 27. Similarly, the upper portion of the fractioning/separating device 25 is connected to a pipe arranged between the main restrictor 23 and the heat source side heat exchanger 24 via a parallel circuit consisting of a second auxiliary restrictor 28 and a second check valve 29. A reservoir 30 is disposed below the fractioning/separating device 25, the lower portion of the reservoir 30 being connected to a pipe arranged between the main restrictor 23 and the heat source side heat exchanger 24 via a valve 31 and a third check valve 32. The lower portion of the reservoir 30 is connected to a pipe arranged between the main restrictor 23 and the utilization side heat exchanger 22 via the valve 31 and a fourth check valve 33. Furthermore, the structure is so arranged that refrigerant in the reservoir 30 is heated by a heater 34.

The manipulation and the operation of the heat pump apparatus for varying the composition of enclosed nonazeotropic mixed refrigerant will be described.

In the non-separation mode at the time of the heating operation, a portion of refrigerant discharged from the utilization side heat exchanger 22 is introduced into the main restrictor 23 by opening the valve 31, the refrigerant thus introduced being then constricted to a low pressure level before being introduced into the heat source side heat exchanger 24. The residual portion of the liquid refrigerant passes through the first auxiliary restrictor 26 during which liquid refrigerant is constricted to a low pressure level before being allowed to branch above the fractioning/separating device 25. After this branching, a portion of the liquid refrigerant passes through the second check valve 29 before being introduced into the heat source side heat exchanger 24, while the residual portion is introduced into the reservoir 30 at which excess refrigerant is reserved. The refrigerant passes through the valve 31 and the third check valve 32 before being introduced into the heat source side heat exchanger 24. As a result, the main circuit is caused to be operated with maintaining the composition of the mixed refrigerant enriched with high boiling point refrigerant whose state has been unchanged from the time when it was enclosed.

In the separation mode at the time of cooling operation, a portion of the refrigerant discharged from the heat source side heat exchanger 24 is introduced into the main restrictor 23 before passing through the main circuit. Then, it passes through the fractioning/separating device 25 through a second restrictor 28 before being introduced into the reservoir 30 at which excess refrigerant is retained. The residual refrigerant passes through the valve 31 and the fourth check valve 33 before passing through the utilization side heat exchanger 22. As a result, the main circuit is caused to be operated while maintaining the composition of the mixed refrigerant enriched with high boiling point refrigerant whose state has been unchanged from the time when it was enclosed.

In a separation mode at the time of the heating operation, the valve 31 is closed and the heater 34 is operated. As a result, low boiling point refrigerant of liquid refrigerant in the reservoir 30 is mainly evaporated, the evaporated refrigerant then moving upwards in the fractioning/separating device 25. At this time, two-phase refrigerant consisting of liquid and gas is supplied from the outlet point of the first auxiliary restrictor 26 to the upper portion of the fractioning/separating device 25. A portion of the thus supplied liquid refrigerant moves downward in the fractioning/separating device 25. Then, the liquid refrigerant encounters a gas-liquid contact with gas which is moving upwards, causing refraction to take place. As a result, the density of the low boiling point refrigerant in the gas which is moving unwards is raised, while the density of the high boiling point refrigerant in the refrigerant in the liquid which is moving downwards is raised. Thus, the reservoir 30 retains high boiling point refrigerant in a condensed liquid. On the other hand, the gas enriched with low boiling point refrigerant which has moved upwards is mixed with a portion of the supplied refrigerant before passing through the second check valve 29. Then, it is introduced into the heat source side heat exchanger 24. As a result, the main circuit can be operated while maintaining the composition of the mixed refrigerant enriched with low boiling point refrigerant.

In this case, since the pressure in the fractioning-/separating device 25 is arranged to be the low pressure in the main circuit, the specific volume of the gas generated is large, and the velocity of the gas which is upward moving in the fractioning/separating device 25 is thereby increased. As a result, the gas-liquid contact is promoted, causing the separating performance of the fractioning/separating device 25 is improved. Therefore, the density of the high boiling point refrigerant retained in the reservoir 30 can be significantly raised. Since the composition of the refrigerant in the main circuit becomes a composition enriched with low boiling point refrigerant which having a significant heating performance, the main circuit can satisfactorily cope with an increase in heating load.

In the separation mode at the time of the cooling operation, the valve 31 is closed and the heater 34 is operated similarly. As a result, low boiling point refrigerant of liquid refrigerant in the reservoir 30 is mainly evaporated, the evaporated refrigerant then moving upwards in the fractioning/separating device 25. At this time, two phase refrigerant consisting of liquid and gas is supplied from the outlet port of the second auxiliary restrictor 28 to the upper portion of the fractioning-/separating device 25. A portion of the thus supplied liquid refrigerant moves downward in the fractioning-/separating device 25. Then, the liquid refrigerant encounters a gas-liquid contact with gas which is moving upwards, causing fraction to take place. As a result, the main circuit can be operated while maintaining the composition of the mixed refrigerant enriched with low boiling point refrigerant similar to the case of the heating operation, the composition exhibiting excellent cooling performance. Therefore, the apparatus can cope with an increase in the load.

When the composition of the refrigerant in the main circuit is intended to restore, it is necessary to only open the valve 31 in both cases of the heating and the cooling operations since the high boiling point refrigerant in the reservoir 16 is mixed with that in the main circuit, causing the composition of the refrigerant in the main circuit to become a composition enriched with high boiling point refrigerant whose state has been unchanged from the time when it was enclosed.

As described above, the composition of refrigerant in the main circuit can be significantly varied by simply operating the valve 31 and the heater 34. Therefore, the composition of the refrigerant can be easily controlled so as to cope with the magnitude of the load applied. As a result, the range in which the performance can be varied can be widened.

Figure 4:
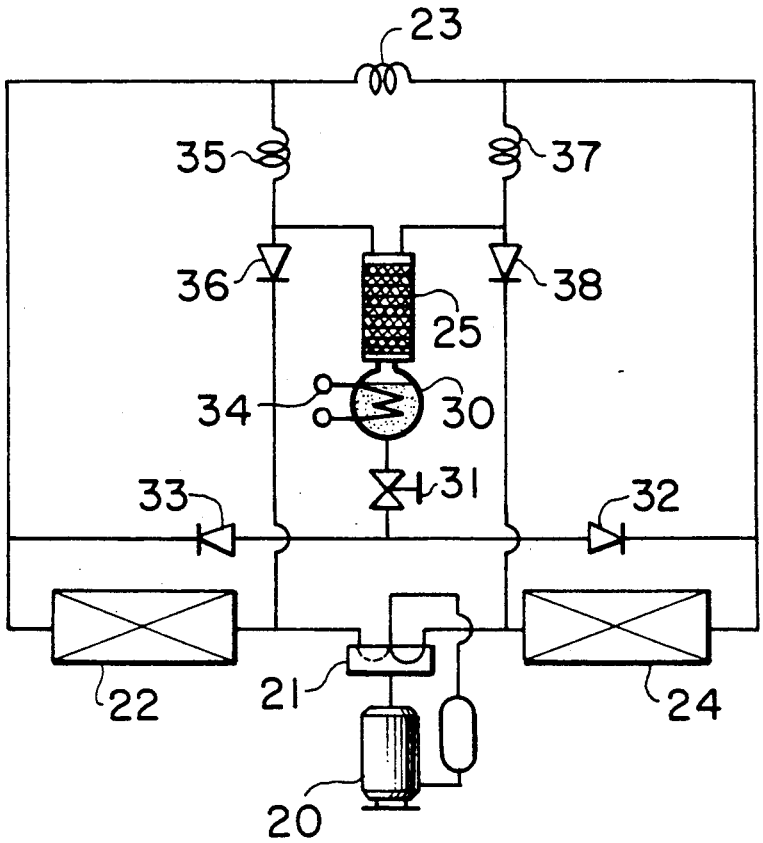
FIG. 4 is a view which illustrates another embodiment of the heat pump apparatus according to the present invention and structured so as to be capable of switching the mode between heating and cooling operations.

FIG. 4 is a view which illustrates another embodiment of the heat pump apparatus according to the present invention structured so as to conduct switching between the heating and cooling operations. Like elements as those shown in FIG. 3 are given like reference numerals.

According to this embodiment, the upper portion of the fractioning/separating device 25 is connected to a pipe arranged between the main restrictor 23 and the utilization side heat exchanger 22 via a first auxiliary resistor 35. The upper portion is also connected to a pipe arranged between the four-way valve 21 and the utilization side heat exchanger 22 via a first check valve 36. Similarly, the upper portion of the fractioning-/separating device 25 is connected to a pipe arranged between the heat source side heat exchanger 24 and the main restrictor 23 via a second auxiliary restrictor 37.

The upper portion also connected to a pipe arranged between the four-way valve 21 and the heat source side heat exchanger 24 via a second check valve 38.

According to this embodiment, in the non-separation mode at the time of heating and the cooling operations, refrigerant discharged from the first auxiliary restrictor 35 or the second auxiliary restrictor 37 passes through the fractioning/separating device 25 before being introduced into the reservoir by opening the valve 31. The excess refrigerant is retained in the reservoir 30. The refrigerant then passes through the valve 31 and the third check valve 32 or the fourth check valve 33 before passing through the main circuit. Therefore, the main circuit can be operated while maintaining the mixed composition of refrigerant enriched with high boiling point which is in the enclosed state.

In the separation mode at the time of the heating operation, the valve 31 is closed. Since the fraction at this time is conducted at a low pressure similarly to the structure shown in FIG. 3, high performance separation can be conducted. Gas generated from the liquid refrigerant in the reservoir 30 due to the heat supplied from the heater 34 and moves upwards in the fractioning-/separating device 25 is sucked by the compressor 20 after passing through the second check valve 38 and the four-way valve 21. As a result, the pressure loss taken place in the heat source side heat exchanger 24 can be reduced so that the composition of the refrigerant in the main circuit can be made to be a composition of mixture enriched with low boiling point refrigerant while the coefficient of performance is maintained at a high level.

In the separation mode at the time of cooling operation, the valve 31 is similarly closed. Since the fraction can be conducted at a low pressure similarly, high performance separation can be conducted. Gas generated from the liquid refrigerant in the reservoir 30 due to the heat supplied from the heater 34 and moves upwards in the fractioning/separating device 25 is sucked by the compressor 20 after passing through the first check valve 36 and the four-way valve 21. As a result, the pressure loss taken place in the utilization side heat exchanger 22 serving as a heat source side heat-exchanger can be reduced so that the composition of the refrigerant in the main circuit can be made to be a composition of mixture enriched with low boiling point refrigerant while the coefficient of performance is maintained at a high level.

When the composition of the refrigerant in the main circuit is intended to restore, it is necessary to only open the valve 31 in both cases of the heating and the cooling operations since the high boiling point refrigerant in the reservoir 30 is mixed with that in the main circuit, causing the composition of the refrigerant in the main circuit to become a composition enriched with high boiling point refrigerant whose state has been unchanged from the time when it was enclosed.

As described above, the composition of refrigerant in the main circuit can be significantly varied by conducting the separation at a low pressure in both heating and cooling operations simply by operating the valve 31 and the heater 34. Furthermore, gas generated in the reservoir 30 can be directly sucked by the compressor 20. As a result, the operation is made with a high coefficient of performance.

Figure 5:
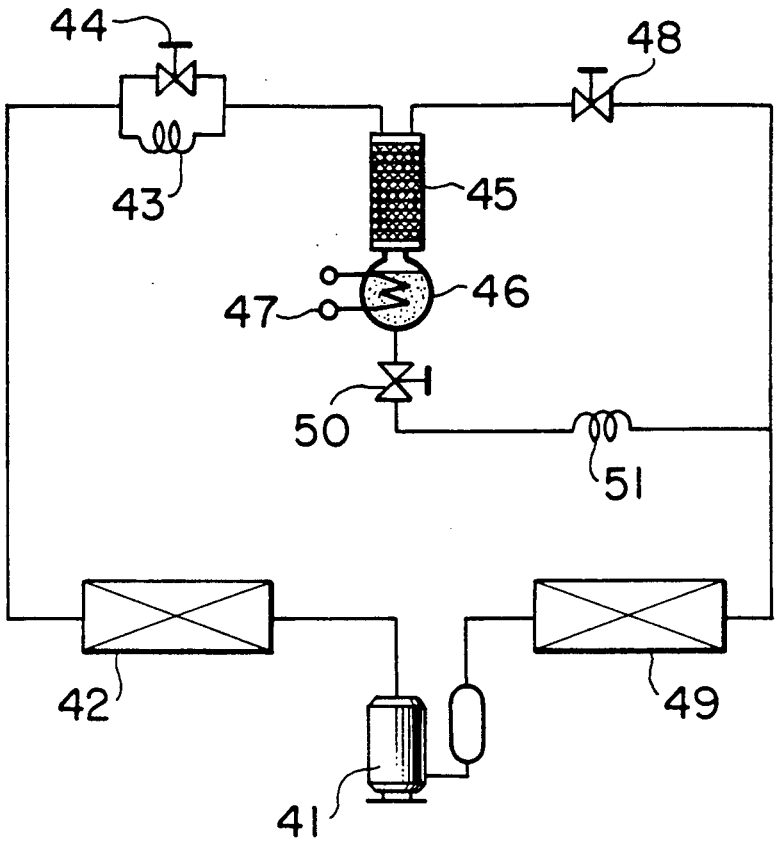
FIG. 5 is a view which illustrates the structure of the heat pump apparatus according to the present invention and arranged in such a manner that the pressure of the fractioning/separating device is switched in accordance with the determined modes.

FIG. 5 is a view which illustrates the other embodiment of the heat pump apparatus according to the present invention and structured so as to switch the pressure at the fractioning/separating device in accordance with a selected mode. Referring to the figure, reference numeral 41 represents a compressor, 42 represents a utilization side heat exchanger (a condenser), 43 represents a first restrictor which is connected to a first valve 44 so as to form a parallel circuit. Reference numeral 45 represents a fractioning/separating device filled with filler, the fractioning/separating device 45 having 9 reservoir 46 and a heater 47 in the lower portion thereof. The upper portion of the fractioning/separating device 45 is connected to the parallel circuit formed by the first restrictor 43 and the first valve 44. The upper portion is also connected to the heat source side heat exchanger 49 via a second valve 48. The lower portion of the reservoir 46 is connected to the heat source side heat exchanger 49 via a third valve 50 and a second restrictor 51, and the heat source side heat exchanger 49 is connected to the compressor 41.

The method of varying the composition of the enclosed nonazeotropic mixed refrigerant in the heat pump apparatus structured as described above will be described. In the non-separation mode, the first valve 44 and the third valve 50 are opened, while the second valve 48 is closed. As a result, liquid refrigerant condensed in the utilization side heat exchanger 42 is introduced, with its high pressure being maintained, into the reservoir 46 via the first valve 44 and the rectifying-/separating device 45. The reservoir 46 is substantially filled with the refrigerant. The refrigerant is then restricted by the second restrictor 51 down to a low pressure after it has passed through the third valve 50. The refrigerant is then introduced into the heat source side heat exchanger 49. Thus, the main circuit can be operated while maintaining the composition of the mixed refrigerant enriched with high boiling point refrigerant whose state has been unchanged from the time when it was enclosed. According to this embodiment, the reservoir 46 is always filled with refrigerant.

In the separation mode, the first valve 44 and the third valve 50 are closed, while the second valve 48 is opened and the heater 47 is operated. As a result, the pressure of liquid refrigerant condensed by the utilization side heat exchanger 42 is lowered to a certain low level by the first restrictor 43 so as to become a two-phase state before being supplied to the upper portion of the fractioning/separating device 45. A portion of the liquid refrigerant moves downwards in the fractioning-/separating device 45. Low boiling point refrigerant of the refrigerant in the reservoir 46 heated by the heater 47 is mainly evaporated and then moves upwards in the fractioning/separating device 45. Then, as a result of a gas-liquid contact with liquid refrigerant moving downwards, the fraction takes place. As a result, the density of the low boiling point refrigerant in the gas which moves upwards is raised, while the density of high boiling point refrigerant in the liquid which moves downwards is raised. As a result, high boiling point refrigerant is retained in the reservoir 46 in a state of condensed liquid. The gas enriched with low boiling point refrigerant which has moved upwards is reduced in pressure at the first restrictor 43 to a certain low level. Then, it passes through the second valve 48 together with two-phase refrigerant consisting of gas and liquid before being introduced into the heat source side heat exchanger 49. As a result, the main circuit can be operated with maintaining the composition of the mixed refrigerant enriched with low boiling point refrigerant.

According to this embodiment, the pressure at the fractioning/separating device 45 is arranged to be a high pressure which is equal to that of the main circuit in the non-separation mode, while the same is arranged to be a low pressure which is equal to that of the main circuit in the separation mode. Therefore, the quantity of refrigerant reserved is maintained to be substantially the same between the separation and the non-separation modes. As a result, the quantity of refrigerant in the main circuit can be maintained to be substantially constant in both modes. Therefore, excessive charge or lacking for refrigerant can be prevented, causing proper quantity of refrigerant to be always maintained in all of the modes if the initial quantity of the refrigerant is determined properly. As a result, operation exhibiting high coefficient of performance can be conducted.

In the separation mode, the velocity of gas which moves upwards in the fractioning/separating device can be increased by conducting the separation at a low pressure. As a result, the separating performance of the fractioning/separating device can be improved, causing the density of the high boiling point refrigerant to be reserved can be significantly raised. As a result, the composition of refrigerant in the main circuit can become a composition enriched with low boiling point refrigerant which exhibits excellent heating performance. Therefore, the apparatus can satisfactorily cope with an increase in the load.

In order to restore the composition of refrigerant in the main circuit, it is necessary for the first valve 44 and the third valve 50 to be opened and for the second valve 48 to be closed. As a result, high boiling point refrigerant in the reservoir 46 is mixed with refrigerant in the main circuit so that the composition of refrigerant in the main circuit becomes the composition of mixed refrigerant enriched with high boiling point refrigerant whose state has been unchanged from the time when it was enclosed.

Furthermore, since the temperature of the fractioning/separating device, the container of the reservoir, and the pipes has been raised considerably in the non-separation mode, the refrigerant which has been lowered in its pressure is heated by sensible heat when the mode has been switched to the separation mode. Therefore, gas can be easily generated in the early stage, causing time required to conduct the separation can be shortened.

Furthermore, when discharged gas or the like discharged from the compressor and having a high temperature is used, the size of the heater can be significantly reduced, causing significant advantages in practical use.

Figure 6:
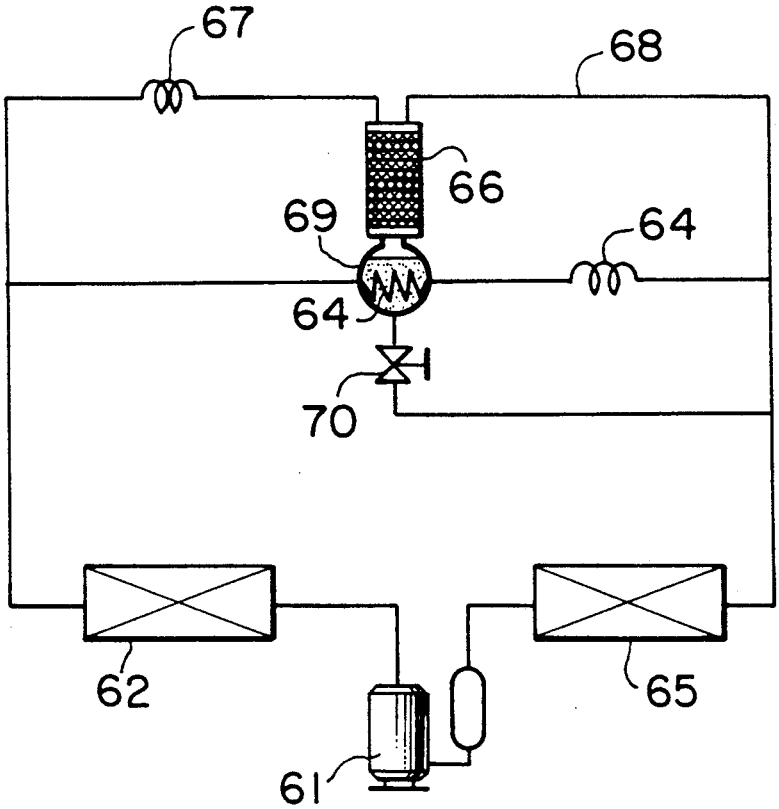
FIG. 6 is a view which illustrates the structure of the heat pump apparatus according to the present invention in which the high pressure liquid refrigerant in the main circuit is used as the heat source.

FIG. 6 is a view which illustrates the structure of the other embodiment of the heat pump apparatus according to the present invention and arranged to use high pressure liquid refrigerant in the main circuit as its heat source. Referring to the drawing, reference numeral 61 represents a compressor, 62 represents a utilization side heat exchanger, 63 represents a heater, 64 represents a first restrictor, and 65 represents a heat source side heat exchanger. The above-described elements are connected by using pipes so that the main circuit is formed. Reference numeral 66 represents a fractioning/separating device filled with filler. The fractioning/separating device 66 has the upper portion connected to a pipe between the utilization side heat exchanger 62 and the heater 63 via a second restrictor 67. The upper portion is also connected to a pipe arranged between the heat source side exchanger 65 and the compressor 61 by a pipe 68. A reservoir 69 including the heater 63 is disposed below the fractioning/separating device 66. A reservoir 69 including the heater 63 is disposed below the fractioning/separating device 66. The lower portion of the reservoir 69 is connected to a pipe arranged between the heat source side heat exchanger 65 and the first restrictor 64 via a valve 70.

The method of varying the composition of enclosed nonazeotropic mixed refrigerant in the heat pump apparatus will be described. In the non-separation mode, the pressure of a portion of liquid refrigerant condensed by the utilization side heat exchanger 62 is lowered to a certain low level by the second restrictor. As a result, two-phase state consisting of gas and liquid is introduced into the reservoir 69 via the fractioning/separating device 66. A portion of the refrigerant is retained as excess refrigerant in the reservoir 66. The residual refrigerant is introduced into the heat source side heat exchanger 65 via the valve 70. Thus, the main circuit can be operated with maintaining the composition of the mixed refrigerant enriched with high boiling point refrigerant which is in the state when the refrigerant has been enclosed.

In the separation mode, when the valve 70 is closed, low boiling point refrigerant of the refrigerant in the reservoir 69 is mainly evaporated by using high temperature liquid refrigerant as its heat source. The thus evaporated low boiling point refrigerant moves upwards in the fractioning/separating device 66. At this time, the pressure of a portion of the liquid refrigerant which has been condensed by the utilization side heat exchanger 62 is lowered in the second restrictor 67 to a certain level so as to become a two-phase state before being supplied to the upper portion of the fractioning/separating device 66. The portion of the liquid refrigerant moves downwards before being subjected to a gas-liquid contact with the low boiling point refrigerant gas which is moving upwards. As a result, the fraction takes place, resulting in that the density of the low boiling point refrigerant in the gas which is moving upwards is raised, while the density of the high boiling point refrigerant in the gas which is moving downwards is raised. As a result, the high boiling point refrigerant in the form of condensed liquid is retained in the reservoir 69. On the other hand, the pressure of the gas enriched with low boiling point refrigerant which has been moved upwards is reduced in the second restrictor 64. Refrigerant then passes through the pipe 68 together with the generated gas before being introduced into the heat source side heat exchanger 65. As a result, the main circuit can be operated with maintaining the composition of the mixed refrigerant enriched with low boiling point refrigerant. High temperature high pressure liquid refrigerant introduced into the heater 63 after it has been discharged from the utilization side heat exchanger 62 is derived of heat by heating liquid refrigerant in the reservoir 69, causing its entropy to be reduced. As a result, the quantity of heat received by the heat source side heat exchanger 65 can be increased, and the coefficient of performance can be improved. Liquid refrigerant introduced into the upper portion of the fractioning/separating device 66 is reduced in pressure by the first restrictor 67 to a certain low level, causing the liquid to be brought into a saturated state. Therefore, gas can be easily generated. Since the pressure in the fractioning/separating device 66 has been arranged to be equal to the pressure in the main circuit, the specific volume of the generated gas is large enough to increase the velocity of gas which moves upwards in the fractioning separating device 66. As a result, the gas-liquid contact is promoted so that the separating performance of the fractioning separating device 66 can be improved, and the density of high boiling point liquid refrigerant retained in the reservoir 69 can be significantly raised. Thus, the composition of the refrigerant in the main circuit can become a composition enriched with low boiling point refrigerant having excellent heating performance. As a result, the apparatus can sufficiently cope with an increase in the load.

In order to restore the composition of refrigerant in the main circuit, it is necessary to open the valve 20 since high boiling point refrigerant is mixed into the refrigerant in the main circuit. Thus, the composition of the refrigerant in the main circuit can be made mixed with refrigerant composition enriched with high boiling point refrigerant.

Although the heater 63 is disposed at an intermediate position of the pipe arranged between the utilization side heat exchanger 62 and the first restrictor 64. The discharge pipe provided for the compressor 61 may, of course, be used. In this case, since heating temperature is sufficiently high to obtain practical advantages such as reduction in the size of the heater 63.

According to this embodiment, the structure is so arranged that the upper portion of the fractioning-/separating device 66 is connected to the heat source side heat exchanger 65 by using the pipe 68. However the upper portion may be connected to the inlet side of the compressor 61. In this case, since the gas generated can be arranged not to pass through the heat source side heat exchanger 65, pressure loss can be reduced, and thereby coefficient of performance can be improved.

Figure 7:
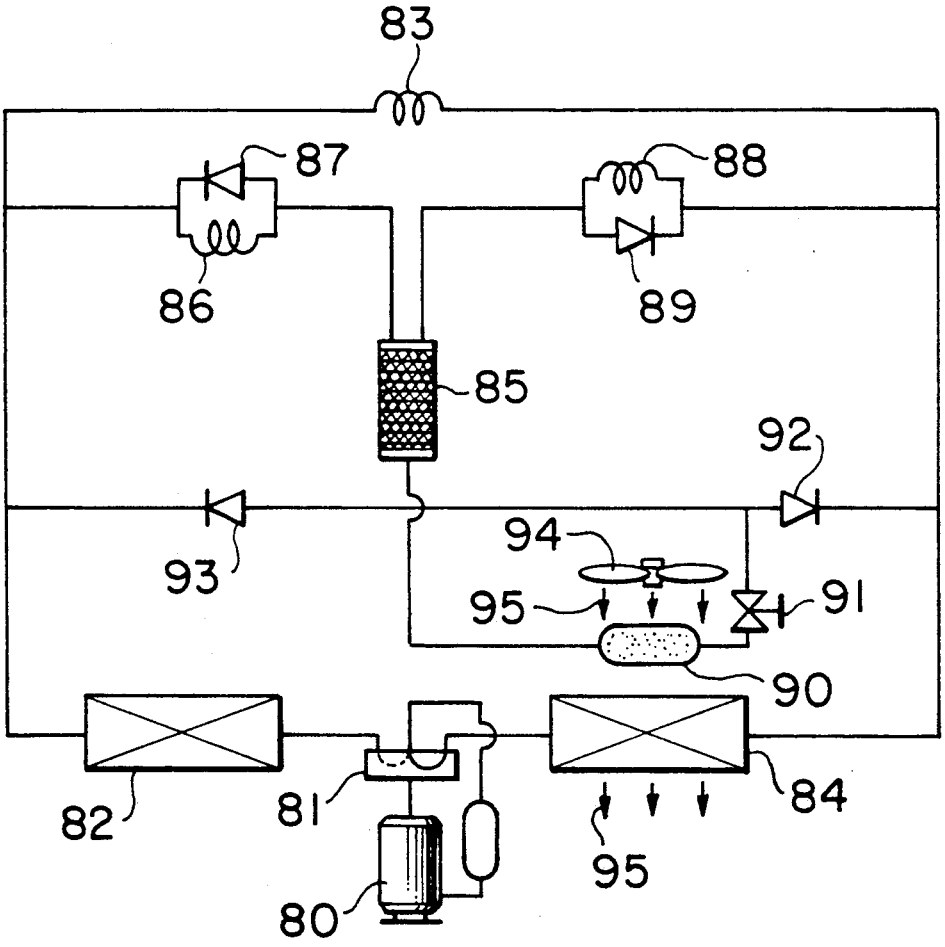
FIG. 7 is a view which illustrates the heat pump apparatus in which the heat source side heat exchanger is used as the heat source and structured so as to be capable of switching the mode between the heating and cooling operations.

FIG. 7 is a view which illustrates the structure of the heat pump apparatus according to the present invention and structured so as to conduct switching between heating and cooling operations. Referring to the drawing, reference numeral 80 represents a compressor, 81 represents a four-way valve, 82 represents a utilization side heat exchanger, 83 represents a main restrictor, and 84 represents a heat source side heat exchanger. The main circuit of the heat pump apparatus according to this embodiment is formed by connecting the above-described elements. Reference numeral 85 represents a fractioning/separating device filled with filler. The upper portion of the fractioning/separating device 85 is connected to a pipe arranged between the utilization side heat exchanger 82 and the main restrictor 83 via a parallel circuit formed by a first auxiliary restrictor 86 and a first check valve 87. Similarly, the upper portion of the fractioning/separating device 85 is connected to a pipe arranged between the main restrictor 83 and the heat source side heat exchanger 84 via a parallel circuit formed by a second auxiliary restrictor 88 and a second check valve 89. A reservoir 90 is disposed below the fractioning/separating device 85. The lower portion of the reservoir 90 is connected to the pipe arranged between the main restrictor 83 and the heat source side heat exchanger 83 via a valve 91 and a third check valve 92. The lower portion is also connected to the pipe arranged between the main restrictor 83 and the utilization side heat exchanger 82 via the valve 91 and a fourth check valve 93. The reservoir 90 is structured so as to exchange heat to and from the ambient air 95 blown by a fan 94 and serving as the heat source of the heat source side heat exchanger 84.

The manipulation and operation of the heat pump apparatus for varying the composition of enclosed nonazeotropic mixed refrigerant will be described.

In the non-separation mode at the time of heating operation, when the valve 91 is opened, a portion of refrigerant passing through the main circuit passes through the fractioning/separating device 85 via the first auxiliary restrictor 86 before being introduced into the reservoir 90. The excess portion of the refrigerant is retained in the reservoir 90, and the residual portion passes through the valve 91 and the third check valve 92 before being introduced into the heat source side heat exchanger 84. As a result, the main circuit can be operated while maintaining the composition of mixed refrigerant enriched with high boiling point refrigerant which is in the state when the refrigerant has been enclosed.

In the non-separation mode at the time of the cooling operation, refrigerant discharged from the second auxiliary restrictor 88 passes through the fractioning-/separating device 85 before being introduced into the reservoir in which the excess portion of the refrigerant is reserved. The residual refrigerant passes through the valve 91 and the fourth check valve 93 before being introduced into the utilization side heat exchanger 82. As a result, the main circuit can be operated with maintaining the composition of mixed refrigerant enriched with high boiling point refrigerant whose state has been unchanged from the time when it was enclosed.

In the separation mode at the heating operation, the valve 91 is stopped. Since temperature of refrigerant in the reservoir 90 is substantially the same as that at inlet port of the heat source side heat exchanger 84 disposed in the main circuit at this time, heat is transmitted from the ambient air 95 of high temperature which is supplied by the fan 94, to the reservoir 90. As a result, low boiling point refrigerant of liquid refrigerant in the reservoir 90 is mainly evaporated so that the evaporated refrigerant moves upwards in the fractioning/separating device 85. At this time, two-phase refrigerant consisting of liquid and gas is supplied from the outlet port of the first auxiliary restrictor 86 to the upper portion of the fractioning/separating device 85. The portion of liquid refrigerant of the supplied refrigerant moves downwards in the fractioning/separating device 85 before being subjected to a gas-liquid contact with the gas which is moving upwards, causing the fraction to take place. As a result, the density of low boiling point refrigerant in the gas which is moving upwards is raised, while the density of high boiling point refrigerant of liquid which is moving downwards is raised. Therefore, high boiling point refrigerant in the form of condensed liquid is retained in the reservoir 90. On the other hand, gas enriched with low boiling point refrigerant which has moved upwards is mixed with a portion of supplied refrigerant before passing through the second check valve 89. Then, refrigerant is introduced into the heat source side heat exchanger 84. As a result, the main circuit can be operated with maintaining the composition of mixed refrigerant enriched with low boiling point refrigerant. In this case, since the pressure in the fractioning/separating device 85 is arranged to be low pressure, the separating performance can be improved. Furthermore, since the ambient air 95 is used as the heat source, the heating performance does not deteriorate. Thus, the composition of the refrigerant can be varied with high coefficient of performance being maintained.

Furthermore, when the quantity of refrigerant to be circulated in the main circuit is increased by raising the revolution speed of the compressor 80 and so forth in order to generate heating performance which can cope with an increased load, temperature of evaporation is lowered so as to balance the quantity of heat exchanged in the heat source side heat exchanger 84. Therefore, the pressure in the reservoir is lowered, causing the generation of gas to be increased temporarily. Furthermore, temperature of refrigerant in the reservoir is caused to be lowered. Therefore, the different in the temperature from that of the ambient air 95 is increased. As a result, the quantity of heat is increased, causing the generation of gas is promoted and thereby the separation action to be also promoted. As a result, the composition of refrigerant in the main circuit becomes a composition enriched with low boiling point refrigerant exhibiting an excellent heating performance. Therefore, the apparatus can satisfactorily cope with an increase in the load. On the contrary, in the case where the quantity of refrigerant to be circulated is reduced due to the reduction in the load, evaporation temperature is raised, causing the quantity of heat to be supplied to the reservoir 90 to be reduce. As a result, the separation action cannot be promoted, causing the composition of refrigerant in the main circuit to become a composition enriched with high boiling point refrigerant having limited heating performance. Thus, the apparatus can sufficiently cope with a decrease in the load.

In the separation mode at the time of cooling operation, the valve 91 is also closed. Since temperature of refrigerant in the reservoir 90 is substantially equal to that at the inlet port of the utilization side heat exchanger 82 in the main circuit at this time, heat is transmitted from the ambient air 95 of high temperature supplied by the fan 94, to the reservoir 90. As a result, low boiling point refrigerant of liquid refrigerant in the reservoir 90 is mainly evaporated so that the evaporated refrigerant moves upwards in the fractioning/separating device 85. At this time, two-phase refrigerant consisting of liquid and gas is supplied from the outlet port of the second auxiliary restrictor 88 to the upper portion of the fractioning/separating device 85. The portion of liquid refrigerant of the supplied refrigerant moves downwards in the fractioning/separating device 85 before being subjected to a gas-liquid contact with the gas which is moving upwards, causing the fraction to take place. As a result, the main circuit can be operated while maintaining the composition of mixed refrigerant enriched with low boiling point refrigerant similarly to the heating operation. Also in this case, since the fractioning/separating device 85 is operated at a low pressure, excellent separating performance can be exhibited. Furthermore, the composition of refrigerant which can cope with a change in the load can be obtained by adjusting the quantity of refrigerant which passes through the main circuit.

In order to restore the composition of refrigerant in the main circuit, it is necessary for the valve 91 to be opened in both heating and the cooling modes since the high boiling point refrigerant in the reservoir 90 is mixed with refrigerant in the main circuit and thereby the composition of refrigerant in the main circuit can be restored to the state when the refrigerant has been enclosed.

As described above, the composition of refrigerant in the main circuit can be significantly varied by conducting the separation at a low pressure of the main circuit in both heating and cooling modes, the variation of the composition being capable of maintaining a high coefficient of performance without deterioration in heating and cooling performance. Furthermore, since the composition of refrigerant corresponding to the magnitude of the load can be easily controlled in accordance with change in the quantity of refrigerant to be circulated. As a result, the range in which the performance can be varied can be widened.

Figure 8:
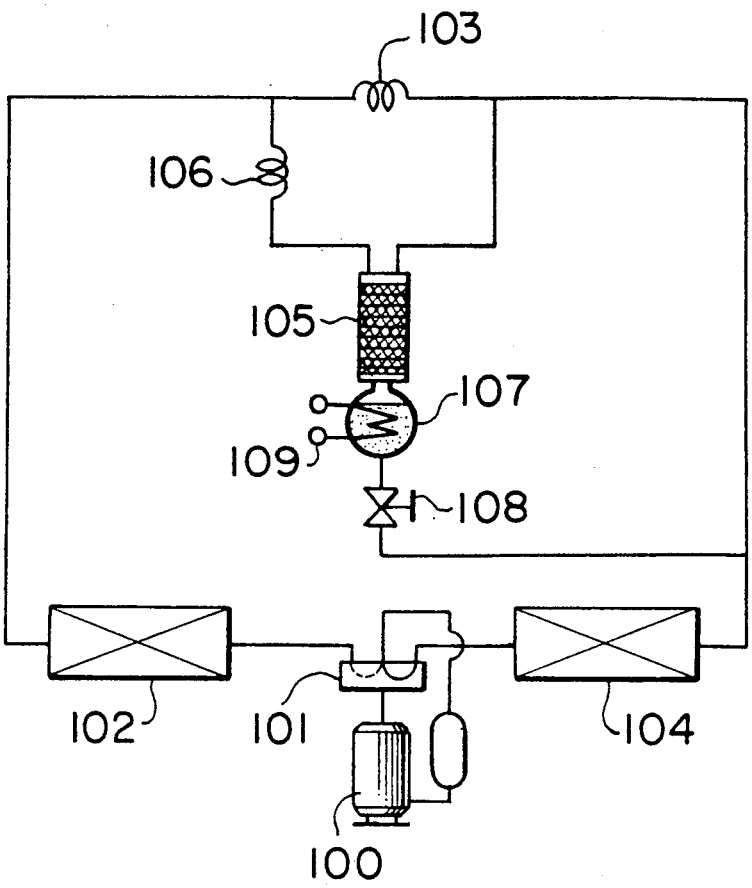
FIG. 8 is a view which illustrates the structure of the heat pump apparatus according to the other embodiment of the present invention structured so as to be capable of switching the mode between the heating and cooling operations.
Figure 9:
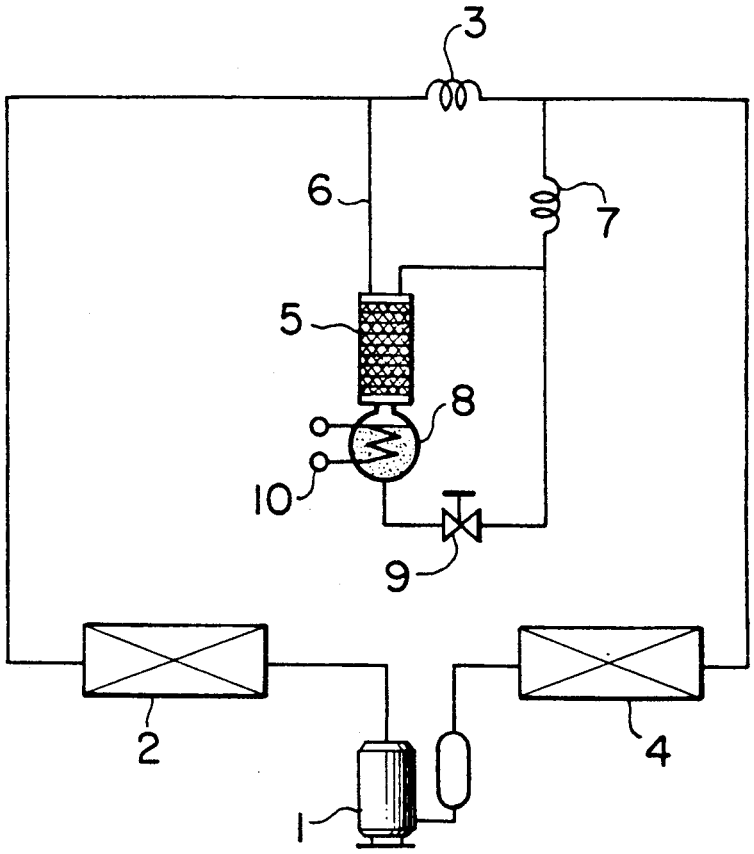
FIG. 9 (PRIOR ART)
FIG. 9 is a view which illustrates a conventional heat pump apparatus.

FIG. 8 is a view which illustrates the other embodiment of the structure of the heat pump apparatus according to the present invention, capable of switching between heating mode and cooling mode. Referring to the figure, reference numeral 100 represents a compressor, 101 represents a four-way valve, 102 represents a utilization side heat exchanger, 103 represents a main restrictor, and 104 represents a heat source side heat exchanger. The main circuit of the heat pump apparatus according to this embodiment is formed by connecting the above-described elements. Reference numeral 105 represents a fractioning separating device filled with filler. The upper portion of the fractioning separating device 105 is connected to a pipe arranged between the utilization side heat exchanger 102 and the main restrictor 103 via an auxiliary restrictor 106. The upper portion of the fractioning/separating device 105 is also connected to a pipe arranged between the main restrictor 103 and the heat source side heat exchanger 104. A reservoir 107 is disposed below the fractioning/separating device 105. The low portion of the reservoir 107 is connected to the pipe arranged between the main restrictor 103 and the heat source side heat exchanger 104 via a valve 108. The refrigerant in the reservoir 107 is arranged to be heated by a heater 109.

Then, the manipulation and operation of the heat pump apparatus for varying the composition of enclosed nonazeotropic mixed refrigerant will be described.

In the separation mode at the time of heating operation, a portion of liquid refrigerant discharged from the utilization side heat exchanger 102 is introduced into the main restrictor 103 by opening the valve 108. The pressure of the refrigerant is lowered to a certain low level through the main restrictor 103 before being introduced into the heat source side heat exchanger 104. The residual liquid refrigerant passes through an auxiliary restrictor 106 during which it is restricted to a certain low pressure. The liquid refrigerant branches out above the fractioning/separating device 105. As a result, a portion of liquid refrigerant is introduced into the heat source side heat exchanger 104, while the residual liquid refrigerant is introduced into the reservoir 107 in which the excess portion of the refrigerant is reserved. The residual refrigerant passes through the valve 108 before being introduced into the heat source side heat exchanger 104. As a result, the main circuit can be operated with maintaining the composition of refrigerant enriched with high boiling point refrigerant which is in the state when the refrigerant has been enclosed.

In the non-separation mode at the time of the cooling operation, a portion of refrigerant discharged from the heat source side heat exchanger 104 is introduced into the main restrictor 103 before passing through the main circuit. The residual portion of refrigerant is introduced into the fractioning/separating device 105 via the valve 108 after it has passed through the reservoir 107 in which the excess portion of refrigerant is reserved. The residual portion passes through the auxiliary restrictor 106 before being introduced into the utilization side heat exchanger 102. As a result, the main circuit can be operated with maintaining the composition of mixed refrigerant enriched with high boiling point refrigerant whose state has been unchanged from the time when it was enclosed.

In the separation mode at the time of heating operation, it is necessary for the valve 108 to be closed and for the heater 109 to be operated. As a result, low boiling point refrigerant of liquid refrigerant in the reservoir 107 is mainly evaporated, and it moves upwards in the fractioning/separating device 105. At this time, two-phase refrigerant consisting of liquid and gas is supplied through the outlet port of the auxiliary restrictor 106 to the upper portion of the fractioning/separating device 105. Liquid refrigerant of the supplied refrigerant moves downwards in the fractioning/separating device 105 and is subjected to gas-liquid contact with gas which is moving upwards, causing the fraction to take place. As a result, the density of low boiling point refrigerant of the gas which is moving upwards is raised. On the contrary, the density of high boiling point refrigerant of liquid which is moving downwards is raised. As a result, the high boiling point refrigerant in the form of condensed liquid is retained in the reservoir 107. On the other hand, gas enriched with low boiling point refrigerant and moved upwards is mixed with a part of supplied refrigerant before being introduced into the heat source side heat exchanger 104. As a result, the main circuit can be operated while maintaining the composition of mixed refrigerant enriched with low boiling point refrigerant.

In this case, since the pressure of refrigerant in the fractioning/separating device 105 is arranged to be a low level, the specific volume of generated gas is large enough to raise the velocity of gas which is moving upwards in the fractioning/separating device 105, causing the gas-liquid contact to be promoted. Therefore, the separating performance of the fractioning/separating device 105 is improved, causing the density of high boiling point refrigerant retained in the reservoir 107 to be raised significantly. As a result, the composition of refrigerant in the main circuit can become a composition enriched with low boiling point refrigerant exhibiting excellent heating performance. As a result, the apparatus can sufficiently cope with an increase in the heating load.

In the separation mode at the cooling operation, the valve 108 is also closed, and the heater 109 is operated. As a result, low boiling point refrigerant of liquid refrigerant in the reservoir 107 is mainly evaported. Thus, the evaporated refrigerant moves upwards in the fractioning/separating device 105. Liquid refrigerant is supplied through the outlet port of the heat source side heat exchanger 104 to the upper portion of the fractioning/separating device 105. A portion of the supplied liquid refrigerant moves downward in the fractioning-/separating device 105 before being subjected to a gas-liquid contact with gas which is moving upwards, causing the fraction to occur. Therefore, similarly to the heating operation, the main circuit can be operated with maintaining the composition of mixed refrigerant enriched with low boiling point refrigerant.

In order to restore the composition of refrigerant in the main circuit, it is necessary for the valve 108 to be simply opened. Thus, high boiling point refrigerant in the reservoir is mixed with refrigerant in the main circuit, causing the composition of refrigerant in the main circuit to become a composition enriched with high boiling point refrigerant whose state has been unchanged from the time when it was enclosed.

As described above, the composition of refrigerant in the main circuit can be significantly varied in both heating and cooling operations simply by operating the valve 108 and the heater 109. Therefore, the composition of refrigerant can be easily controlled corresponding to a change in the load, causing the range in which performance can be varied to be widened.

As an alternative to the heater 109, a structure may be employed in which gas refrigerant of high pressure in the main heat pump circuit is used as the heat source to apply heat to liquid refrigerant in the reservoir. In this case, the load of the heat source side heat exchanger 104 can be reduced at the time of the cooling operation.

What is claimed is:

1. A heat pump apparatus comprising:

a main heat pump circuit in which nonazeotropic mixed refrigerant is enclosed and structured by a compressor, a utilization side heat exchanger, a restrictor, and a heat source side heat exchanger; and a fractioning/separating device provided with a reservoir and a heater, said fractioning/separating device having an upper portion wherein the upper portion is connected to an outlet port of said restrictor, said upper portion is also connected to an inlet port of said heat source side heat exchanger, whereby the pressure at said fractioning/separating device is made to be as high as a low pressure in said main heat pump circuit.

2. A heat pump apparatus according to claim 1, wherein said reservoir is connected to a low pressure pipe from said main heat pump circuit via a valve.

3. A heat pump apparatus according to claim 1, wherein the lower portion of said reservoir is connected to a low pressure pipe of said main circuit via a valve.

4. A heat pump apparatus according to claim 1, wherein said main heat pump circuit is operated, said valve is closed, and said heater is operated for a predetermined time period before the operation of said heater is stopped.

5. A heat pump apparatus according to claim 1, wherein said utilization side heat exchanger and the upper portion of said fractioning/separating device are connected to each other by a parallel circuit formed by a first restrictor and a first valve, said upper portion is connected to an inlet port of said heat source side heat exchanger via a second valve, and said reservoir is connected to an inlet port of said heat source side heat exchanger via a third valve and an auxiliary restrictor.

6. A heat pump apparatus according to claim 1, wherein the heat source of said heater is obtained from a high pressure liquid refrigerant in said main heat pump circuit.

7. A heat pump apparatus according to claim 1, wherein the heat source of said heater is obtained from the heat source for said utilization side heat exchanger in said main heat pump circuit or the heat source for said utilization side heat exchanger.

8. A heat pump apparatus according to claim 1, wherein nonazeotropic mixed refrigerant consisting of R22 and refrigerant having a boiling point which is higher than that of R22, both said refrigerants being mixed so as to make its vapor pressure substantially the same as that of R12.

9. A heat pump apparatus according to claim 1, wherein said refrigerant having the boiling point higher than that of R22 includes at least one of R134a, R152a, R134, R124, R142b, RC318, R143, R123, R123a, and R141b.

10. A heat pump apparatus comprising:

a main heat pump circuit in which nonazeotropic mixed refrigerant is enclosed and structured by a compressor, a four-way valve, a utilization side heat exchanger, a main restrictor, a heat source side heat exchanger, and the like; and a fractioning/separating device provided with a reservoir and a heater, wherein the upper portion of said fractioning/separating device is connected to a pipe arranged between said utilization side heat exchanger and said main restrictor via a parallel circuit formed by a first auxiliary restrictor and first check valve, and said upper portion is also connected to a pipe arranged between said heat source side heat exchanger and said main restrictor via a parallel circuit formed by a second auxiliary restrictor and a second check valve.

11. A heat pump apparatus comprising:

a main heat pump circuit in which nonazeotropic mixed refrigerant consisting of R22 and refrigerant having a boiling point which is higher than that of R22 is enclosed, both said refrigerants being mixed so as to make its vapor pressure substantially the same as that of R12, and structured by a compressor, a four-way valve, a utilization side heat exchanger, a main restrictor, a heat source side heat exchanger, and the like; and a fractioning/separating device provided with a reservoir and a heater, wherein the upper portion of said fractioning/separating device is connected to a pipe arranged between said main restrictor and said utilization side heat exchanger via a first auxiliary restrictor, is also connected to a pipe arranged between said four-way valve and said utilization side heat exchanger via a first check valve, is also connected to a pipe arranged between said heat source side heat exchanger and said main restrictor via a second auxiliary restrictor, and is connected to a pipe arranged between said four-way valve and said heat source side heat exchanger via a second check valve.

12. A heat pump apparatus comprising:

a main heat pump circuit in which nonazeotropic mixed refrigerant is enclosed and structured by a compressor, a four-way valve, a utilization side heat exchanger, a main restrictor, a heat source side heat exchanger, and the like; and a fractioning/separating device provided with a reservoir and a heater, wherein the upper portion of said fractioning/separating device is connected to a pipe arranged between said utilization side heat exchanger and said main restrictor via an auxiliary restrictor, and said upper portion is also connected to a pipe arranged between said heat source side heat exchanger and said main restrictor.

13. A heat pump apparatus according to claim 12, wherein said reservoir is connected to a pipe arranged between said main restrictor and said heat source side heat exchanger through said main restrictor.

14. A heat pump apparatus according to claim 12, wherein liquid refrigerant in said reservoir is heated by using high pressure gas refrigerant in said main heat pump circuit as a heat source.

* * * * *